US006564019B2

(12) United States Patent
Ahn et al.

(10) Patent No.: US 6,564,019 B2
(45) Date of Patent: May 13, 2003

(54) IMAGE FORMING APPARATUS

(75) Inventors: Byung-sun Ahn, Kyungki-do (KR); Dong-ha Choi, Kyungki-do (KR); Hyun-ho Lee, Seoul (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/982,819

(22) Filed: Oct. 22, 2001

(65) Prior Publication Data

US 2002/0114634 A1 Aug. 22, 2002

(30) Foreign Application Priority Data

Feb. 19, 2001 (KR) ..... 2001-8242

(51) Int. Cl.[7] ..... G03G 15/00

(52) U.S. Cl. ..... 399/13; 399/110; 399/124; 399/364

(58) Field of Search ..... 399/110, 124, 399/401, 364, 13, 107; 271/902

(56) References Cited

U.S. PATENT DOCUMENTS 4,974,033 A * 11/1990 Yamada et al. ..... 399/124
5,049,946 A * 9/1991 Harada ..... 399/110
5,384,619 A * 1/1995 Yokomizo et al. ..... 399/364 X
5,839,032 A * 11/1998 Yasui et al. ..... 399/124
5,878,308 A * 3/1999 Kurata et al. ..... 399/110
5,978,626 A * 11/1999 Nagamine et al. ..... 399/110 X
6,018,640 A * 1/2000 Blackman et al. ..... 399/364
6,134,404 A * 10/2000 Iwai et al. ..... 399/110
6,215,970 B1 * 4/2001 Yoshikawa et al. ..... 399/124

FOREIGN PATENT DOCUMENTS

JP 06-329328 * 11/1994
JP 10-148975 * 6/1998
JP 11-296053 * 10/1999
JP 2001-048429 * 2/2001
JP 2001-235905 * 8/2001

* cited by examiner

*Primary Examiner*—Sophia S. Chen
(74) *Attorney, Agent, or Firm*—Sughrue Mion, PLLC

(57) ABSTRACT

An image forming apparatus capable of duplex printing includes a door panel and a cover panel being connected for relative turning and facing each other for forming the printing paper circulation path so that one-side printed paper can re-enter an image forming engine for duplex printing; a printing paper transferring member being formed in a facing side of the door panel and the cover panel for transferring a printing paper to one direction; and an image forming apparatus capable of duplex printing constructed for more effective dealing with a jammed paper generated in a circulation path, wherein a modular duplex printing unit can be removable and attachable as needed, is formed and the duplex printing unit includes a power transmission device for transferring power generated in a driving unit of a main body.

8 Claims, 7 Drawing Sheets

IMAGE FORMING APPARATUS

BACKGROUND OF THE INVENTION

1. Field of the Invention

The present invention relates to an image forming apparatus such as a laser printer, and more particularly to an image forming apparatus having a duplex printing unit, which is detachably mounted on a main body. The present application is based on Korean Patent Application No. 2001-8242, which is incorporated herein by reference.

2. Description of the Related Art

Generally, a laser printer is representative of image forming apparatuses that use a photo electric printing method for transferring and settling an image on a printing paper after developing an electrostatic latent image formed by scanning a laser beam on a charged photosensitive medium into a visible image by a toner, and the laser printer prints out requested information related to a computer network in page units.

These image forming apparatuses such as a laser printer and a photocopying machine comprise a duplex printing unit for circulating a printing paper to an image forming engine to print out each requested information on both sides of a printing paper, respectively.

In a conventional image forming apparatus, since a duplex printing unit is integrally built in a main body of a printer, it is difficult to make a compact-type printer. Some of the problems associated with the conventional image forming apparatus, which is constructed such that a printing paper circulation path is closed inside of a main body, include dealing with jammed papers and repair.

SUMMARY OF THE INVENTION

The present invention has been made to overcome the above-mentioned problems of the related art. Accordingly, it is an object of the present invention to provide an image forming apparatus capable of duplex printing. The image forming apparatus is modularly constructed such that a duplex printing unit is selectively removable as needed and has a more compact construction.

Another object of the present invention is to provide an image forming apparatus capable of duplex printing having a function that enables a user to deal with a jammed paper generated in a circulation path during printing.

The above objects are accomplished by an image forming apparatus that includes a main body having an engine unit for forming image information on a printing paper and a printing paper transferring path formed therein, along which a printing paper on a cassette is transferred via the engine unit, and a duplex printing unit having a printing paper circulation path formed therein, which is constructed so that a printing paper can re-enter after being reversed in the printing paper transferring path. The duplex printing unit is adapted to be selectively removed from and mounted on the main body.

It is preferable that the duplex printing unit includes: a door panel and a cover panel which are connected to be capable of relative turning by facing each other for forming the printing paper circulation path; printing paper transferring means that is provided on a facing side of the door panel and the cover panel; a power transmission means for transmitting power generated from a driving unit of the main body to the printing paper transferring roller, when mounting the door panel and the cover panel to the main body; and a complementary connection means for connecting the door panel and the cover panel with the main body complementarily.

It is preferable that the printing paper transferring means includes a plurality of transferring rollers and back-up rollers that are installed corresponding to each facing side of the door panel and the cover panel and are engaged with each other.

It is also preferable that the power transmission means is constructed including a driving gear that is installed on a rotational axis of the transferring roller to be engaged with a swing gear formed to be connected with the driving unit of the main body.

In addition, it is advisable that the complementary connection means has four pairs of supplementary members: a pair of flexible ribs protruding from one end of either the door panel or the cover panel; a pair of hinge shafts formed at the end of the elastic ribs; a pair of guide grooves formed on both side walls of a removable unit of the main body for the hinge shafts to slide therealong; and a pair of hinge holes formed at each end of the guide grooves for receiving the hinge shafts.

BRIEF DESCRIPTION OF THE DRAWINGS

The objects and the features of the present invention will be more apparent by describing the preferred embodiment of the present invention referring to the accompanying drawings, in which.

DETAILED DESCRIPTION OF THE PREFERRED EMBODIMENTS

From now on, an image forming apparatus according to the preferred embodiments of the present invention will be described in detail referring to the appended drawings.

Figure 1:
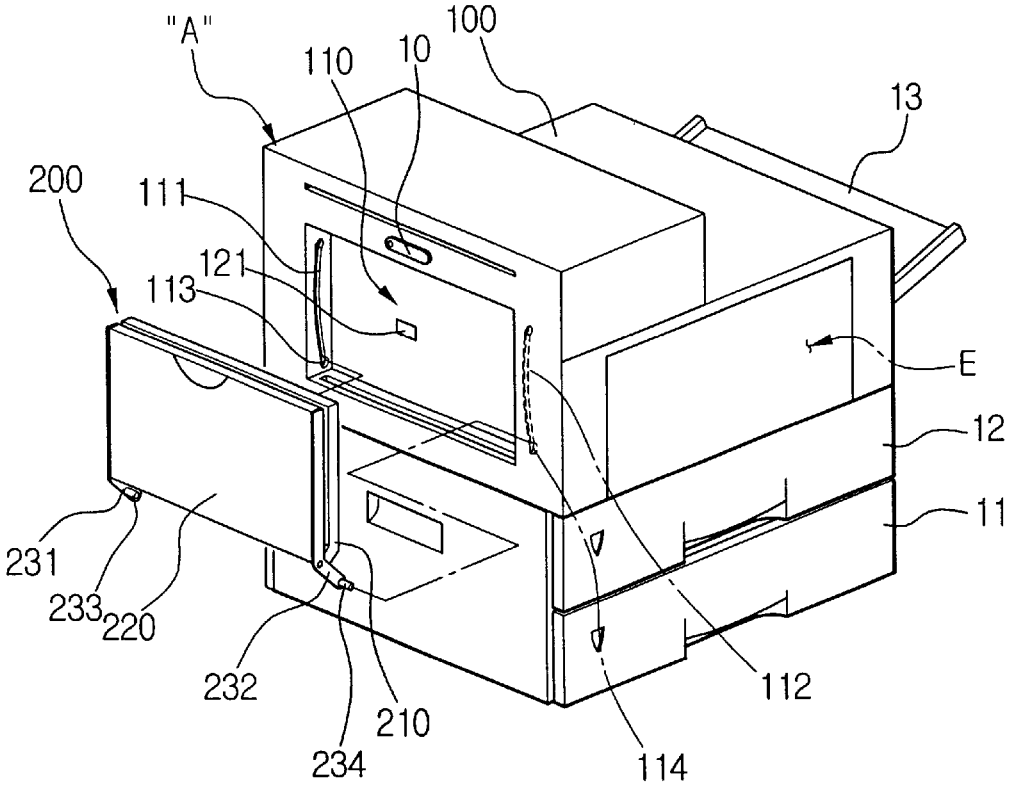
FIG. 1 is an exploded perspective view schematically showing the external appearance of an image forming apparatus according to the present invention.
Figure 2:
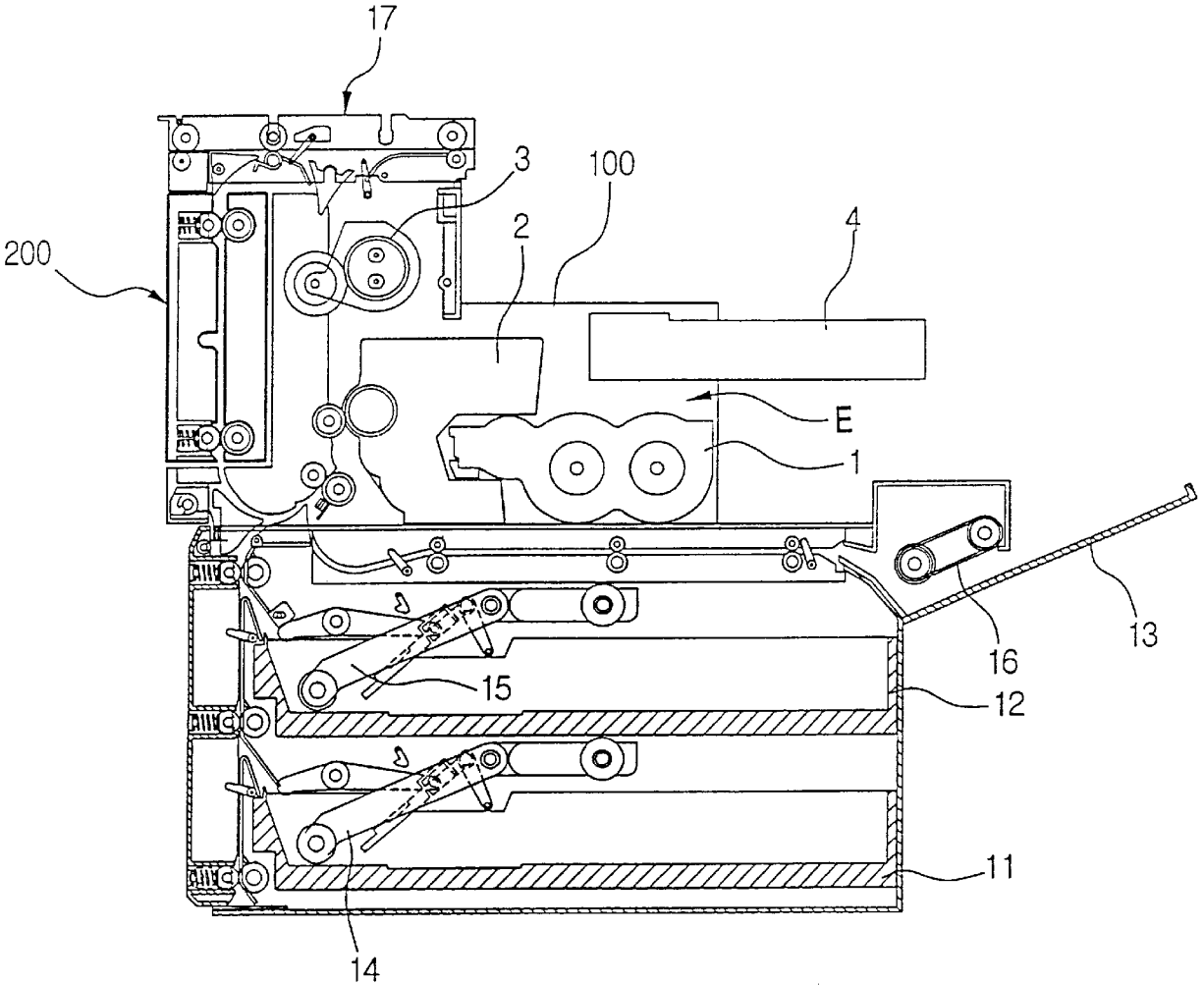
FIG. 2 is a sectional view showing the entire structure of an image forming apparatus according to the present invention.

Referring to FIGS. 1 and 2, an image forming apparatus "A" capable of duplex printing according to the present invention includes a removable unit 110 formed by being sunken-in on one side of a main body 100, that houses an image forming engine unit (E) and a controller (not shown) therein. A duplex printing unit 200 is mounted on, and selectively removable from the removable unit 110 as needed. Also, the image forming apparatus "A" is formed such that a printing paper circulation path, formed in the duplex printing unit 200, can be open.

In the case of a laser printer, the engine unit (E) includes a toner supplying unit 1, a developing unit 2, a settling unit 3, and a laser beam scanning unit 4, and performs printing operation under the control of the controller (not shown). The controller (not shown) sends printing image data to the engine unit (E) as a signal, and also sends a controlling signal for controlling operation of the driving devices of the engine unit (E).

The undescribed reference numeral 10 is a locking member for restricting the duplex printing unit 200 from opening by itself by its turning to the outside of the main body 100. The reference numerals 11 and 12 are cassettes wherein printing papers are piled and distributed automatically, and the reference numeral 13 is a manual printing paper distribution cassette. The undescribed reference numerals 14, 15, and 16 in FIG. 2 are printing paper pick-up units, and the reference numeral 17 is a paper distribution unit.

Figure 3:
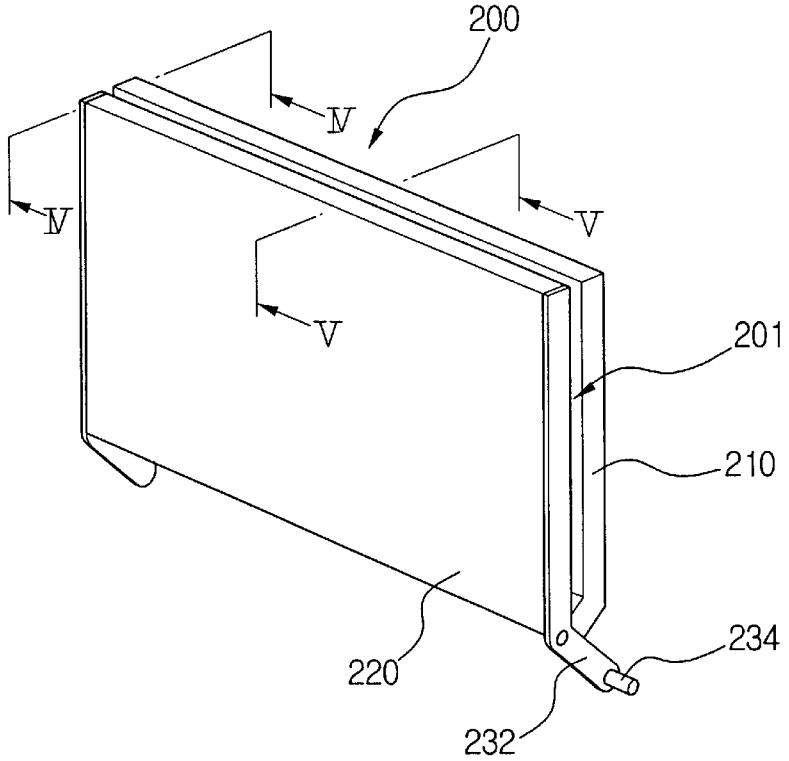
FIG. 3 is a schematic perspective view showing an extracted duplex printing unit of an image forming apparatus according to the present invention.

According to the present invention, the duplex printing unit 200 is constructed as one module and, as shown in FIG. 3, the duplex printing unit 200 has an assembly body wherein a door panel 210 and a cover panel 220, facing each other, can perform relative turning.

The assembly body of the door panel 210 and the cover panel 220 is connected with the main body 100 by the complementary connection member. According to one preferred embodiment of the present invention, the complementary connection member has four pairs of supplementary members: as shown in FIGS. 1 through 4, a pair of flexible ribs 231 and 232 protruding from one and the opposite ends of the cover panel 210; a pair of hinge shafts 233 and 234 formed at the end of the flexible ribs 231 and 232; a pair of guide grooves 111 and 112 formed on both side walls of a removable unit 110 of the main body for receiving the hinge shafts 233 and 234 to slide therealong; and a pair of hinge holes 113 and 114 formed at certain ends of the guide grooves 111 and 112 for receiving the hinge shafts 233 and 234 therein.

A printing paper circulation path 201 for duplex printing is constructed between the door panel 210 and the cover panel 220. The printing paper circulation path 201 enables duplex printing by guiding a printing paper that has finished one-side printing to re-enter the engine (E), and the printing paper circulation path 201 is connected to a printing paper transferring path constructed for one-side printing in the main body 100.

Figure 4:
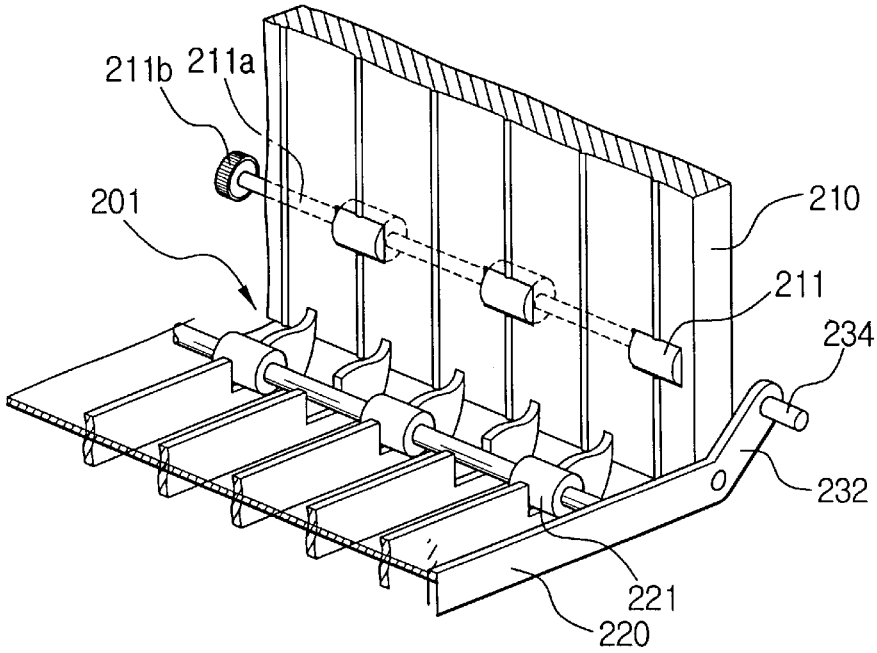
FIG. 4 is a schematic perspective view showing the inner structure of the duplex printing unit of FIG. 3.

As shown in FIG. 4, the cover panel 220 is pivoted open and closed and a printing paper transferring member is formed on the facing side of the door panel 210 and the cover panel 220 for transferring a printing paper that has been one-side printed to re-enter the engine unit (E).

According to the embodiment of the present invention, a plurality of transferring rollers 211 and back-up rollers 221 are formed on the facing side of the door panel 210 and the cover panel 220, to be engaged with each other (see FIG. 4). The plurality of transferring rollers 211 and back-up rollers 221 are designed to transfer power by using a belt pulley or a group of gears.

The transferring rollers 211 comprise a power transmission device for transmitting power generated from a driving unit (refer to reference character 'M' in FIG. 5) of the main body 100 when the duplex printing unit 200 is installed.

Figure 5:
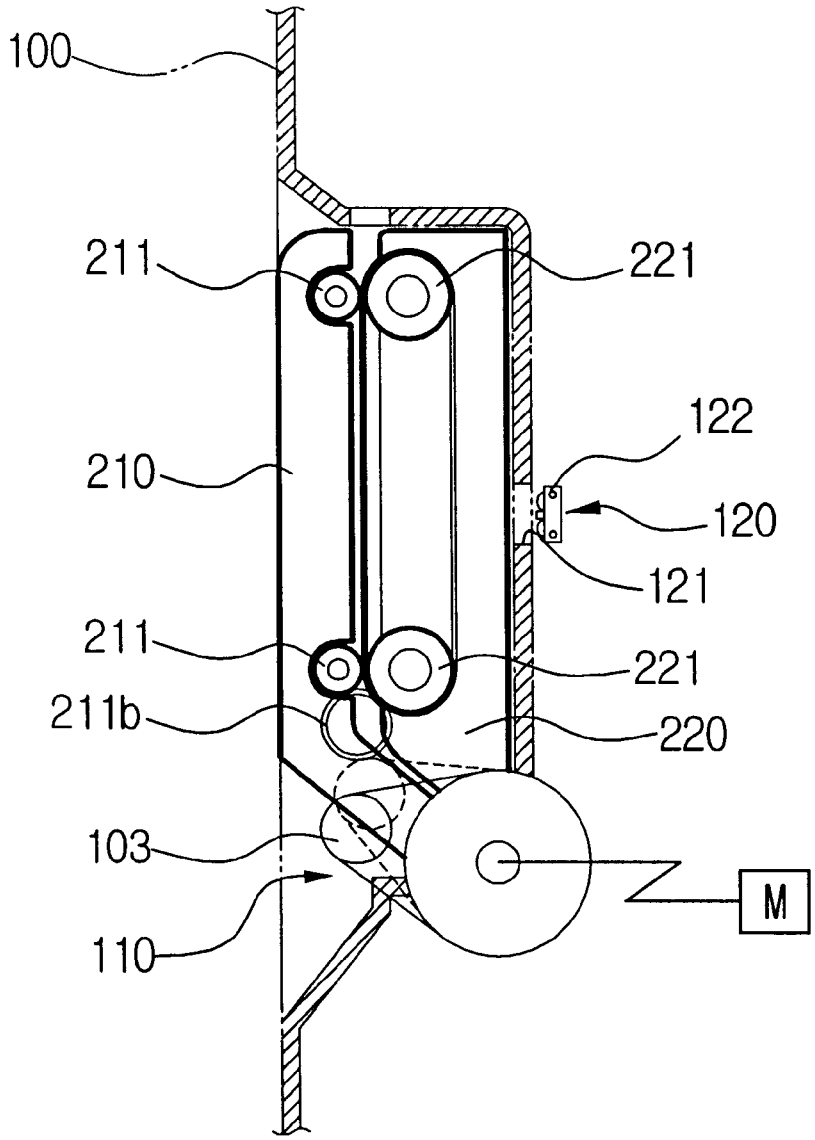
FIG. 5 is a schematic sectional view taken along the line IV—IV of the duplex printing unit of FIG. 3.

According to the embodiment of the present invention, the power transmission device, as shown in FIG. 5, includes a swing gear 103 connected with the driving unit (M) of the main body 100, and a driving gear 211*b* installed on a rotational axis 211*a* of the transferring roller 211 for being engaged with the swing gear 103. At least one transmitting gear can be installed between the swing gear 103 and the driving gear 211*b*.

Meanwhile, according to another aspect of the present invention, a detecting unit 120 is formed in the removable unit 110 of the main body 100 for detecting the existence of the duplex printing unit 200.

According to the embodiment of the present invention, the detecting unit 120, as shown in FIG. 5, includes a transparent window 121 formed in the main body 100, and a photo sensor module 122 for non-contact detecting the existence of the duplex printing unit 200 by projecting the light to the transparent window 121 and detecting the reflected light.

Figure 6:
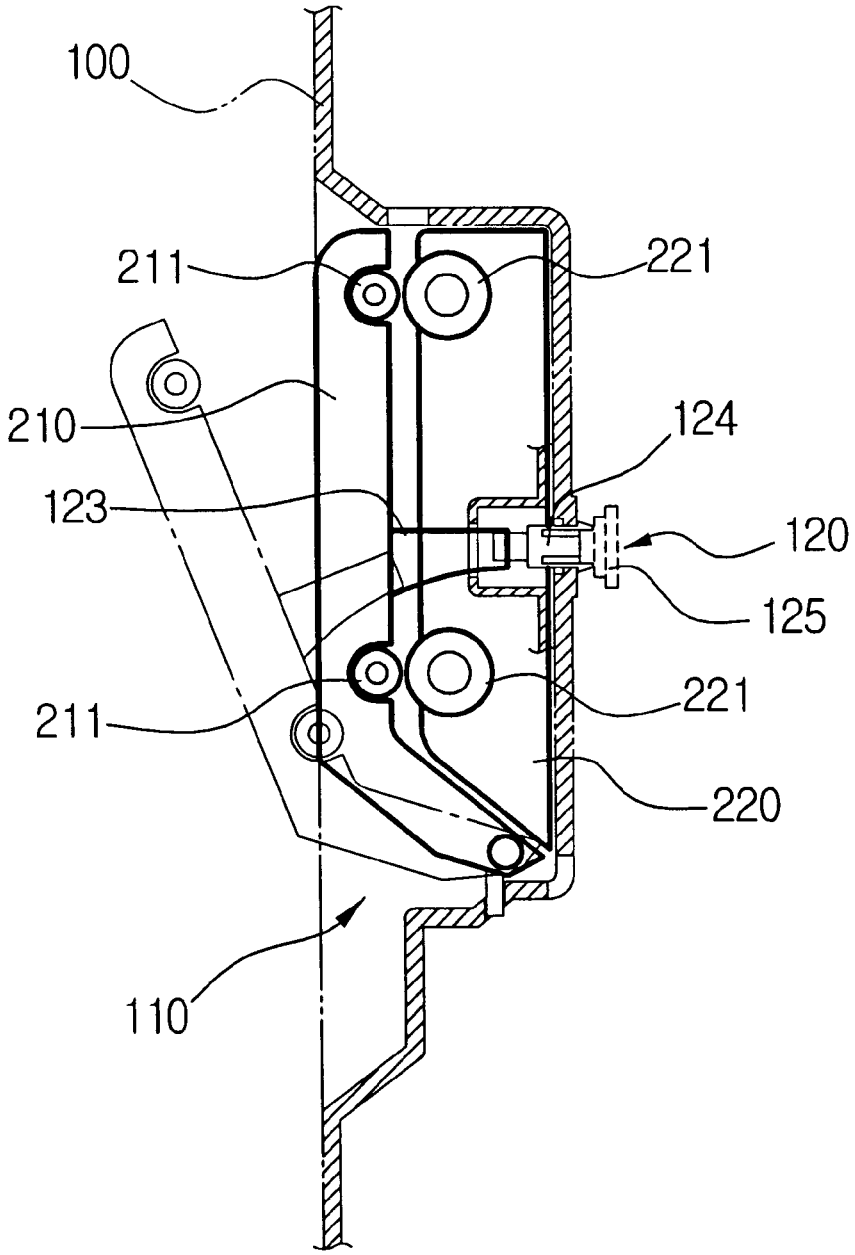
FIG. 6 is a schematic sectional view taken along the line V—V of the duplex printing unit of FIG. 3.

Alternatively, as schematically shown in FIG. 6, in order to detect the existence of the duplex printing unit 200, the detecting device 120 according to another embodiment of the present invention, can be constructed by disposing a sliding pin 124 on the main body 100 to be linearly moved forward and backward by a selective contact with a pin switch 123 disposed in the cover panel 220 or the door panel 210 in accordance with the existence and removal of the duplex printing unit 200 and by disposing an electric switch to be switched by the advance and retreat of the sliding pin 124.

The locking member restricts the cover panel 210 from turning to outer side of the main body 100 and opening.

The operation of mounting and removing of the duplex printing unit 200 of the image forming apparatus according to the present invention constructed as above will be described referring to the appended drawings.

Referring to FIG. 1, when the duplex printing unit 200 is settled in the main body 100, a user inserts the flexible ribs 231 and 232 of the cover panel 220 at both ends of the removal unit 110 of the main body 100 into the guide grooves 111 and 112 by pressing slightly the flexible ribs 231 and 232 of the cover panel 220 inwardly. Next, after releasing the pressure of the flexible ribs 231 and 232, a user slides the hinge axes downwardly for positioning the hinge shafts 233 and 234 in the hinge holes 113 and 114 formed at the end of the guide grooves 111 and 112.

When the duplex printing unit 200 is mounted on the main body 100, the driving gear 211*b* installed on the rotational axis 211*a* of the transferring roller 211 installed in the door panel 210 is engaged with the swing gear 103 connected with the driving unit (M) of the main body 100. The detecting unit 120 detects the existence of the duplex printing unit 200, and sends a signal to the controller. Then the swing gear 103 operates to be engaged with the driving gear 211 by a controlling signal of the controller. By doing so, the duplex printing unit 200 is mounted on the main body 100 and thus power can be transmitted to the transferring roller 211 and the back-up roller 221 which are engaged with each other on the door panel 210 and the cover panel 220 so that duplex printing can be performed by being circulated to the engine unit (E) after one side of the printing paper being printed.

Meanwhile, if the duplex printing unit 200 is mounted on the main body 100, the photo sensor module 122 non-contact detects the existence of the duplex printing unit 200 by using the transparent window 121 formed in the main body 100, and then indicates whether the duplex printing can be performed by outputting a signal to the controller via a control panel or the like.

Alternatively, when the duplex printing unit 200 is mounted on the main body 100, the pin switch 123 of the door panel 210 presses the sliding pin 124 linearly to switch on or off the electric switch 125 and thus detect the existence of the duplex printing unit 200. The pin switch 123 outputs a signal for the detected result to the controller, thereby indicating through the control panel or the like, whether the duplex printing can be performed or not.

From now on, printing paper circulation in the duplex printing action of an image forming apparatus according to the present invention will be described with reference to FIGS. 7 and 8.

Figure 7:
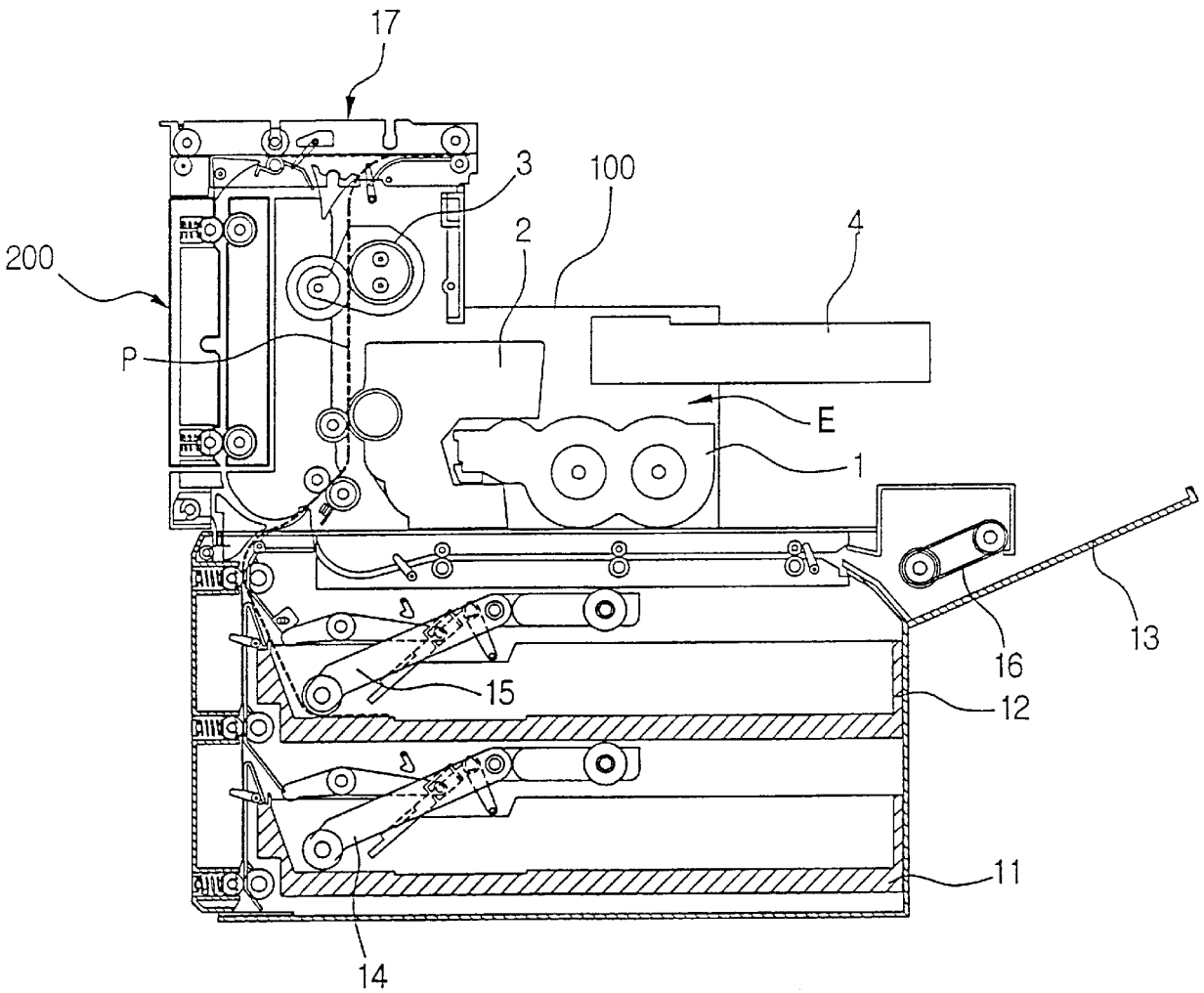
FIG. 7 is a schematic sectional view showing a printing paper transferring path, for describing one-side printing operation of an image forming apparatus according to the present invention.
Figure 8:
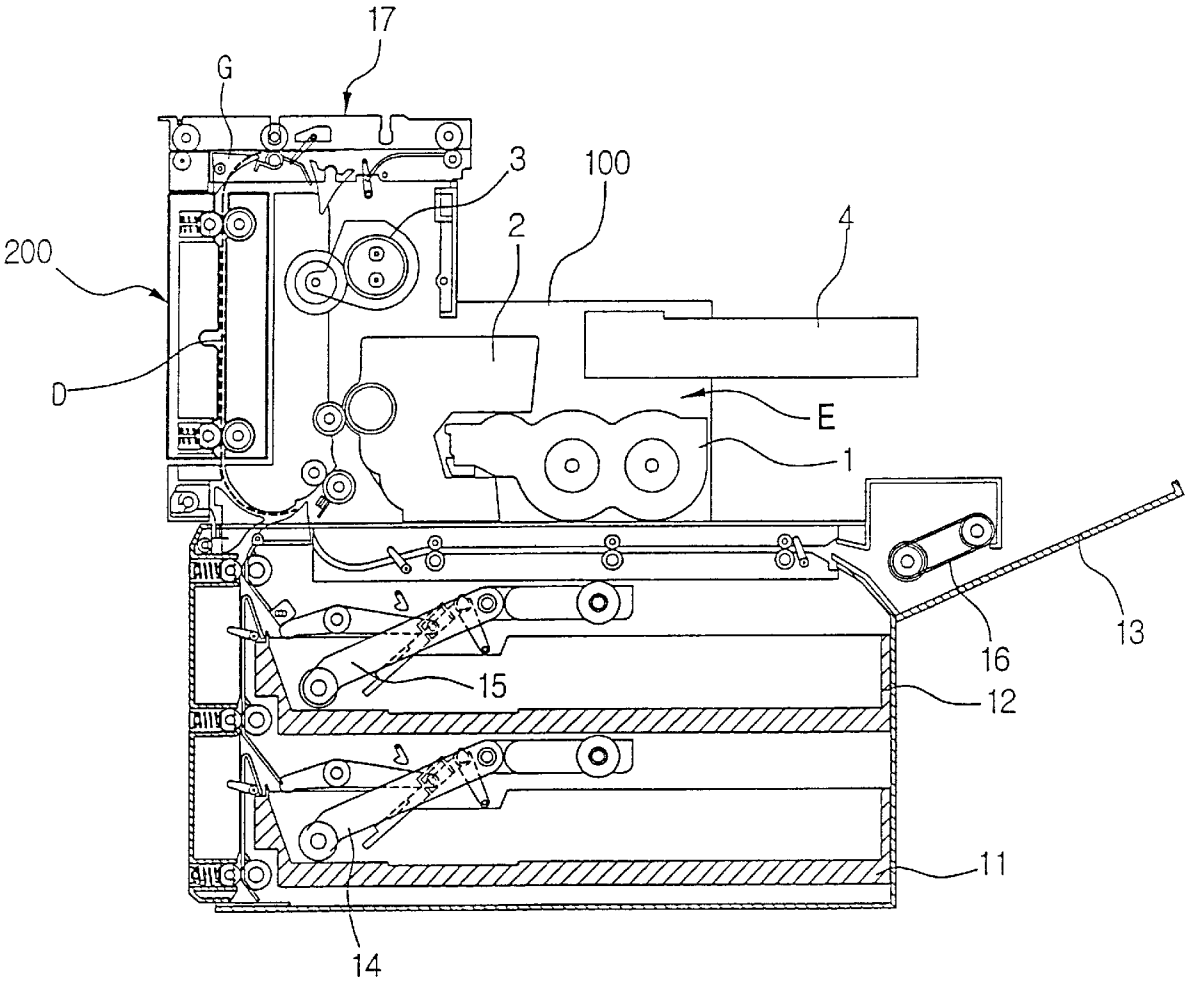
FIG. 8 is a schematic sectional view showing a printing paper circulation path, for describing duplex printing operation of an image forming apparatus according to the present invention.

The reference character 'P' in FIG. 7 is a one-side printing paper transferring path. Pick-up units 14 and 15 pick up one sheet of paper from the printing paper cassette 11 or 12 and transfer the paper to a developing unit 2. Then a toner image is formed on the paper and fixed by heating pressure of the settling unit 3 as a printed image. The one-side printed paper can be either discharged to outside via the distribution unit 17 or re-enter the engine unit (E) via a circulation path like the reference character D in FIG. 8 for printing out new image information on the other side of the paper.

When duplex printing is performed, a one-side printed paper enters printing paper circulation path D of the duplex printing unit 200 by the guidance of a guide member G during a transfer along the transferring path P of the distribution unit 17. Once the printing paper enters the circulation path D, the paper goes through duplex printing process by being transferred to the transferring path P, which is identical to the transferring path P for one-side printing.

The change of the setting position of the guide member G is controlled by sensors installed in the printing paper moving path. For example, it can be sequentially controlled through an operation of driving devices such as a solenoid or limit switch operated by turning lever installed for contacting when a printing paper is transferred.

As described above, according to the present invention, in a state that the duplex printing unit 200 is mounted in the main body 100, when a jammed paper is generated in the circulation path D formed between the cover panel 220 and the door panel 210 during the operation of duplex printing, as shown in FIGS. 4 and 5, the jammed paper can be easily removed by turning and opening the cover panel 220 to the outside of the main body 100.

According to an image forming apparatus of the present invention, since a duplex printing unit 200 can be adapted to be removable and attachable as needed, the image forming apparatus can be constructed to be more compact.

In addition, because the image forming apparatus of the present invention has an open printing paper circulation path formed in the duplex printing unit, jammed paper generated during printing operation can be removed more easily and simply. Therefore, the efficiency and life span of an image forming apparatus can be increased.

So far, the preferred embodiments of the present invention have been shown and described. However, the present invention is not limited to the described embodiments, and without departing from the spirit and scope of the present invention as claimed in the appended claims, someone skilled in the art can variously modify the present invention.

What is claimed is:

1. An image forming apparatus comprising:

a main body having an engine unit for forming image information on a printing paper and a printing paper transferring path formed therein, along which the printing paper is printed out via the engine unit; and a duplex printing unit having a printing paper circulation path formed therein, along which the printing paper is returned back to the engine unit after the printing paper is returned from the engine unit, wherein the duplex printing unit is adapted to be removably mounted on the main body and comprises:

a door panel and a cover panel facing each other, being connected for relative turning, and forming the printing paper circulation path;

printing paper transferring means provided on a facing side of the door panel and the cover panel for feeding the printing paper;

power transmission means for transmitting power to the transferring means from a driving unit of the main body, when the door panel and the cover panel are mounted on the main body; and complementary connection means for complementarily connecting the door panel and the cover panel with the main body, wherein the power transmission means has a driving gear installed on a rotational axis of the printing paper transferring means, the driving gear being engaged with a swing gear connected with the driving unit of the main body, when the door panel and the cover panel are mounted on the main body.

2. The image forming apparatus of claim 1, wherein the printing paper transferring means includes a plurality of transferring rollers and back-up rollers disposed on the facing side of the door panel and the cover panel to correspond to each other, the plurality of transferring rollers and back-up rollers being engaged with each other.

3. The image forming apparatus of claim 1, wherein the printing paper is stored in a cassette in the main body before image information is formed on the printing paper.

4. The image forming apparatus of claim 1, wherein the duplex printing unit is a module, making the duplex printing unit easily mountable on and removable from the main body.

5. An image forming apparatus comprising:

a main body having an engine unit for forming image information on a printing paper and a printing paper transferring path formed therein, along which the printing paper is printed out via the engine unit; and a duplex printing unit having a printing paper circulation path formed therein, along which the printing paper is returned back to the engine unit after the printing paper is returned from the engine unit, wherein the duplex printing unit is adapted to be removably mounted on the main body and comprises:

a door panel and a cover panel facing each other, being connected for relative turning, and forming the printing paper circulation path;

printing paper transferring means provided on a facing side of the door panel and the cover panel for feeding the printing paper;

power transmission means for transmitting power to the transferring means from a driving unit of the main body, when the door panel and the cover panel are mounted on the main body; and complementary connection means for complementarily connecting the door panel and the cover panel with the main body, wherein the complementary connection means comprises:

a pair of elastic ribs protruding from certain ends of the door panel and the cover panel;

a pair of hinge shafts formed at the ends of the elastic ribs;

a pair of guide grooves formed in the main body corresponding to each other so that the hinge shafts can be positioned and slid therealong; and a pair of hinge holes formed at certain ends of the guide grooves respectively for receiving the hinge shafts therein.

6. The image forming apparatus of claim 5, wherein the printing paper transferring means includes a plurality of transferring rollers and back-up rollers disposed on the facing side of the door panel and the cover panel to correspond to each other, the plurality of transferring rollers and back-up rollers being engaged with each other.

7. An image forming apparatus comprising:

a main body having an engine unit for forming image information on a printing paper and a printing paper transferring path formed therein, along which the printing paper is printed out via the engine unit;

a duplex printing unit having a printing paper circulation path formed therein, along which the printing paper is returned back to the engine unit after the printing paper is returned from the engine unit; and detecting means provided in the main body for detecting whether the duplex printing unit is mounted on the main body, wherein the duplex printing unit is adapted to be removably mounted on the main body, wherein the detecting means has a transparent window and a photo sensor for detecting the existence of the duplex printing unit by projecting a light to and detecting the reflected light from the transparent window.

8. An image forming apparatus comprising:

a main body having an engine unit for forming image information on a printing paper and a printing paper transferring path formed therein, along which the printing paper is printed out via the engine unit;

a duplex printing unit having a printing paper circulation path formed therein, along which the printing paper is returned back to the engine unit after the printing paper is returned from the engine unit; and detecting means provided in the main body for detecting whether the duplex printing unit is mounted on the main body, wherein the duplex printing unit is adapted to be removably mounted on the main body, wherein the detecting means has a sliding pin disposed in the main body for being reciprocated forward and backward in a linear direction by a selective contact in accordance with the detection of the duplex printing unit, and a switching member that is electrically switched on and off by selective contact with the sliding pin in accordance with the forward and backward reciprocation of the sliding pin.

* * * * *